US010178739B2

(12) United States Patent
Jonsson

(10) Patent No.: US 10,178,739 B2
(45) Date of Patent: Jan. 8, 2019

(54) ASSIGNING CONTROLLABLE LUMINAIRE DEVICES TO CONTROL GROUPS

(71) Applicant: Zumtobel Lighting Inc., Highland, NY (US)

(72) Inventor: Karl Jonsson, Rancho Santa Margarita, CA (US)

(73) Assignee: Zumtobel Lighting Inc., Highland, NY (US)

( * ) Notice: Subject to any disclaimer, the term of this patent is extended or adjusted under 35 U.S.C. 154(b) by 0 days.

(21) Appl. No.: 15/345,995

(22) Filed: Nov. 8, 2016

(65) Prior Publication Data

US 2018/0132335 A1 May 10, 2018

(51) Int. Cl.
*H05B 37/00* (2006.01)
*H05B 37/02* (2006.01)

(52) U.S. Cl.
CPC ..... *H05B 37/0227* (2013.01); *H05B 37/0272* (2013.01)

(58) Field of Classification Search
CPC ..... H05B 33/0815; H05B 33/0818; H05B 41/2828; H05B 41/3921; H05B 41/3927; H05B 37/029; H05B 33/0803; H05B 37/0254; H05B 37/02
See application file for complete search history.

(56) References Cited

U.S. PATENT DOCUMENTS 8,543,249 B2 * 9/2013 Chemel ..... H05B 37/0272 351/51
2011/0001436 A1 * 1/2011 Chemel ..... H05B 37/029 315/291
2011/0018465 A1 * 1/2011 Ashdown ..... H05B 33/0818 315/294
2012/0025717 A1 * 2/2012 Klusmann ..... H05B 37/0218 315/152
2014/0293276 A1 * 10/2014 Hughes ..... G01J 1/4204 356/222
2015/0147067 A1 * 5/2015 Ryan ..... H04B 10/116 398/118
2015/0296599 A1 * 10/2015 Recker ..... H05B 37/0272 315/153

* cited by examiner

*Primary Examiner* — Minh D A
(74) *Attorney, Agent, or Firm* — Mintz Levin Cohn Ferris Glovsky and Popeo, P.C.; Peter F. Corless; Steven M. Jensen

(57) ABSTRACT

The present invention relates to methods and devices for automatically assigning a controllable luminaire device to a control group for commonly controlling controllable luminaire devices assigned to the control group.

10 Claims, 2 Drawing Sheets

ASSIGNING CONTROLLABLE LUMINAIRE DEVICES TO CONTROL GROUPS

FIELD OF THE INVENTION

The present invention relates to methods for automatically assigning a controllable luminaire device to a control group, and to control devices and systems implementing the methods.

BACKGROUND OF THE INVENTION

Lighting networks enable a comprehensive control of a plurality of luminaire devices. For example, a lighting network may allow to control a plurality of luminaire devices individually from a centralised control device. For example, for each luminaire device a certain function like dim level, colour or optical exposure may be individually controlled. Lighting networks may be employed on both indoor and outdoor lighting of commercial, industrial and residential spaces. For example, in a large store shop windows may each be illuminated by a plurality of luminaire devices. Illumination features of each shop window may be changed depending on the time of day or the products arranged in the shop window. In another example, in a stage lighting several groups of luminaire devices may be assigned to a plurality of different illumination tasks, for example background illumination, foreground illumination, coloured illumination and other special effect illuminations, and the luminaire devices assigned to a special group may be controlled commonly. Therefore, commissioning of groups and scenes in a lighting network has to be conducted when setting up the lighting network.

In this context, commissioning of a luminaire device in a lighting network comprises programming a luminaire device to a dedicated behaviour and/or to become a known located luminaire device in a community of networked luminaire devices. Each dedicated luminaire device may be controlled to perform a certain function like dim level, colour or optical exposure. Furthermore, each dedicated luminaire device may become a member of a device group or a scene. A group of luminaire devices can communicate with each other via a dedicated network. A group control may request all members of a group with support of the requested function to perform an action in synchrony. A scene is a set of functions and their settings supported by a dedicated luminaire device that can be stored and recalled by a control command. A luminaire device may comprise for example a luminaire unit and an integrated control unit with the control unit providing an interface for coupling to the network and controlling the luminaire unit. A luminaire device may also comprise a separate control unit, which may be coupled to a separate luminaire unit for controlling the luminaire unit in response to information received from the network.

Commissioning of groups and scenes in a lighting network is usually done manually. For example, for commissioning and programming lighting networks such as DALI (digital addressable lighting interface) or wired or wireless IP-based networks a so-called "fire and forget" type of action may be performed, where a lighting installation is programmed once and rarely touched. Therefore, changing the commissioning behaviour or re-commissioning the existing setup or replacing luminaire devices requires a skilled professional.

Thus, there is a need for improving and simplifying commissioning of luminaire devices in lighting networks.

SUMMARY OF THE INVENTION

According to the present invention, this object is achieved by methods and devices defined in the independent claims. The dependent claims define additional embodiments of the invention.

According to an embodiment, a method for automatically assigning a controllable luminaire device to a control group for commonly controlling controllable luminaire devices assigned to the control group is provided. A controllable luminaire device may comprise for example a luminaire unit with an integrated control unit, or a separate control unit which may be coupled to a separate luminaire unit. However, the control unit may provide an interface for coupling to a lighting network and may be configured to control the luminaire unit based on commands from the lighting network. According to the method, a sensor value from a sensor unit assigned to the controllable luminaire device is determined. The sensor unit may be coupled to the control unit such that the control unit can communicate the sensor value from the sensor unit to the lighting network. Furthermore, according to the method, the controllable luminaire device is assigned to the control group based on the sensor value.

The sensor value may relate to, for example, a movement value, an orientation value with respect to the geomagnetic poles, an acceleration value, an ambient air pressure value, or a received signal strength value of an electromagnetic wirelessly transmitted communication signal. The sensors may be integrated into the controllable luminaire device. For example, controllable luminaire devices having a certain orientation with respect to the geomagnetic poles or being arranged in a certain floor in a building (determined by the ambient air pressure value) may be automatically assigned to certain groups. Likewise, controllable luminaire devices being arranged on a common carrier and thus performing a same movement or experiencing a certain common acceleration may be grouped together. Finally, controllable luminaire devices receiving an electromagnetic wirelessly transmitted communication signal having a certain signal strength may be assumed to be arranged within a certain area of for example a control device for controlling the controllable luminaire devices via for example a wireless local area network (WLAN). These devices may be assigned to a certain control group automatically. Thus, speed of commissioning may be improved by using sensors assigned to the controllable luminaire devices to intelligently auto group and potentially predict behaviour of a certain group. This may be especially useful in lighting networks that comprise a large number of devices, for example hundreds or thousands of controllable luminaire devices. Finding a certain luminaire device at a time for programming such networks could take a long time without assisted group and filtering. Furthermore, the above-described method allows post installation and reconfiguring of lights without any programming on knowledge of lighting networks by using the sensors assigned to the controllable luminaire devices. This may in particular be helpful in connection with dynamic applications such as spotlights in a shopping window or in a vegetable section of a supermarket.

According to an embodiment, a plurality of control groups comprising the above-mentioned control group is provided. A corresponding sensor value range is assigned to each control group. The sensor value is compared with the sensor value ranges assigned to the control groups, and the controllable luminaire device is assigned to a control group of the plurality of control groups based on the comparison. For example, orientation value ranges may be defined for each control group and each controllable luminaire device having an orientation value within the orientation value range of the certain control group is automatically assigned to the certain control group.

According to another embodiment, a method for grouping a plurality of controllable luminaire devices for commonly controlling a group of controllable luminaire devices is provided. According to the method, for each controllable luminaire device of the plurality of controllable luminaire devices a corresponding sensor value is determined by a sensor unit, which is assigned to the controllable luminaire device. Based on the sensor values of the plurality of controllable luminaire devices at least one control group is created. The control group defines a group of controllable luminaire devices which are to be controlled commonly. Each controllable luminaire device of the plurality of controllable luminaire devices is assigned to a control group of the created at least one control group based on the corresponding sensor value. In other words, according to this embodiment, sensor values of a plurality of controllable luminaire devices are determined and analysed for defining control groups, for example based on similar sensor values. For example, in case the sensor value relates to an orientation value with respect to the geomagnetic poles, a first control group may be created for controllable luminaire devices which are oriented to the north, and a second control group may be created for controllable luminaire devices which are oriented to the south. Each controllable luminaire device directed to the north is assigned to the first control group and each controllable luminaire device directed to the south is assigned to the second control group. Thus, all controllable luminaire devices directing into a certain direction may be controlled commonly and may be grouped automatically.

As indicated above, the sensor values may relate to a movement, an orientation, an acceleration, an ambient air pressure value or a received signal strength value of an electromagnetic wirelessly transmitted communication signal.

According to another embodiment, a control device is provided which comprises an interface unit and a processing unit. The interface unit is configured to receive a sensor value from a sensor unit assigned to a controllable luminaire device. The sensor unit may be embedded in the controllable luminaire device. The processing unit is configured to assign the controllable luminaire device to a control group based on the sensor value. The control group defines a group of controllable luminaire devices which are to be controlled commonly. The control device may be coupled to the controllable luminaire device or may be integrated in a same housing together with the sensor unit and the controllable luminaire device.

Again, the sensor value may relate to a movement value, an orientation value with respect to the geomagnetic poles, an acceleration value, and ambient air pressure value, or a received signal strength value of an electromagnetic wirelessly transmitted communication signal.

Furthermore, a plurality of control groups comprising the control group may be provided. To each control group a corresponding sensor value range may be assigned. The processing unit may be configured to compare the sensor value with the sensor value ranges assigned to the plurality of control groups, and to assign the controllable luminaire device to a control group of the plurality of control groups based on the comparison. In particular, the controllable luminaire device may be assigned to the corresponding control group in case the sensor value lies within the sensor value range assigned to the corresponding control group.

According to another embodiment, a further control device is provided. The control device comprises an interface unit for receiving sensor values of a plurality of sensor units, wherein each sensor unit of the plurality of sensor units is assigned to a corresponding controllable luminaire device of a plurality of controllable luminaire devices. The control device comprises furthermore a processing unit which is configured to create at least one control group based on the sensor values of the plurality of controllable luminaire devices, and to assign each controllable luminaire device of the plurality of controllable luminaire devices to a control group of the created at least one control group based on the corresponding sensor value. Each control group defines a group of controllable luminaire devices to be commonly controlled. The sensor value may relate to a movement value, an orientation value with respect to the geomagnetic poles, an acceleration value, an ambient air pressure value, or a received signal strength value of an electromagnetic wirelessly transmitted communication signal.

According to another embodiment, a system is provided which comprises a controllable luminaire device, a sensor unit assigned to the controllable luminaire device, and a control device. The control device comprises an interface for receiving a sensor value from the sensor unit assigned to the controllable luminaire device, and a processing unit configured to assign the controllable luminaire device to a control group based on the sensor value. The control group defines a group of controllable luminaire devices to be commonly controlled.

The sensor unit maybe integrated in the controllable luminaire device to which the sensor unit is assigned.

Furthermore, the sensor unit may comprise for example a gyroscope configured to determine a movement of the controllable luminaire device. Additionally or as an alternative, the sensor unit may comprise a magnetometer configured to determine an orientation of the controllable luminaire device with respect to the geomagnetic poles. In this case, the sensor unit may be configured to indicate an orientation of the controllable luminaire device in for example a north, south, east, or west direction, as well as an orientation of the controllable luminaire device in an upward, downward, or horizontal direction.

Additionally or as an alternative, the sensor unit may comprise an accelerometer configured to determine an acceleration of the controllable luminaire device, or a pressure sensor configured to determine and ambient air pressure of the controllable luminaire device. Based on the ambient air pressure, an altitude, in which the controllable luminaire device is arranged, may be determined, for example in which floor of a building the controllable luminaire device is arranged. Furthermore, additionally or as an alternative, the sensor unit may comprise a powermeter configured to determine a received signal strength of an electromagnetic wirelessly transmitted communication signal received at the controllable luminaire device. The electromagnetic wirelessly transmitted communication signal may comprise a control signal emitted from a centralised control device for controlling a plurality of controllable luminaire devices. Based on the received signal strength of the electromagnetic wirelessly transmitted communication signal a distance between the receiving controllable luminaire device and the centralised control device may be estimated and corresponding groups of controllable luminaire devices arranged within a certain distance to the centralised control device may be set up.

In another embodiment, a system comprises a plurality of controllable luminaire devices, and a plurality of sensor units, wherein each sensor unit of the plurality of sensor units is assigned to a corresponding controllable luminaire device of the plurality of controllable luminaire devices. The system comprises furthermore a control device which comprises an interface unit for receiving sensor values from the plurality of sensor units, and a processing unit. The processing unit is configured to create at least one control group based on the sensor values of the plurality of controllable luminaire devices. Each control group defines a group of controllable luminaire devices to be commonly controlled. The processing unit is furthermore configured to assign each controllable luminaire device of the plurality of controllable luminaire devices to a control group of the created at least one control groups based on the corresponding sensor value. The control device may be coupled to the plurality of sensor units via a lighting network like DALI or a wired or wireless IP-based network.

Each sensor unit or at least one sensor unit of the plurality of sensor units may be integrated in the corresponding controllable luminaire device to which the sensor unit is assigned. The sensor units may comprise commodity sensors which are known from for example cell phones and which may be very cost effective, robust and small, such that they may be easily integrated into the corresponding controllable luminaire device.

Each sensor unit may comprise for example a gyroscope, a magnetometer, an accelerometer, a pressure sensor, or a power meter.

Although specific features described in the above summary and the following detailed description are described in connection with specific embodiments, it is to be understood that the features of the embodiments may be combined with each other unless specifically noted otherwise.

BRIEF DESCRIPTION OF THE DRAWINGS

The invention will now be described in more detail with reference to the accompanying drawings.

In the following, exemplary embodiments of the invention will be described in more detail. It is to be understood that the features of the various exemplary embodiments described herein may be combined with each other unless specifically noted otherwise.

Figure 1:
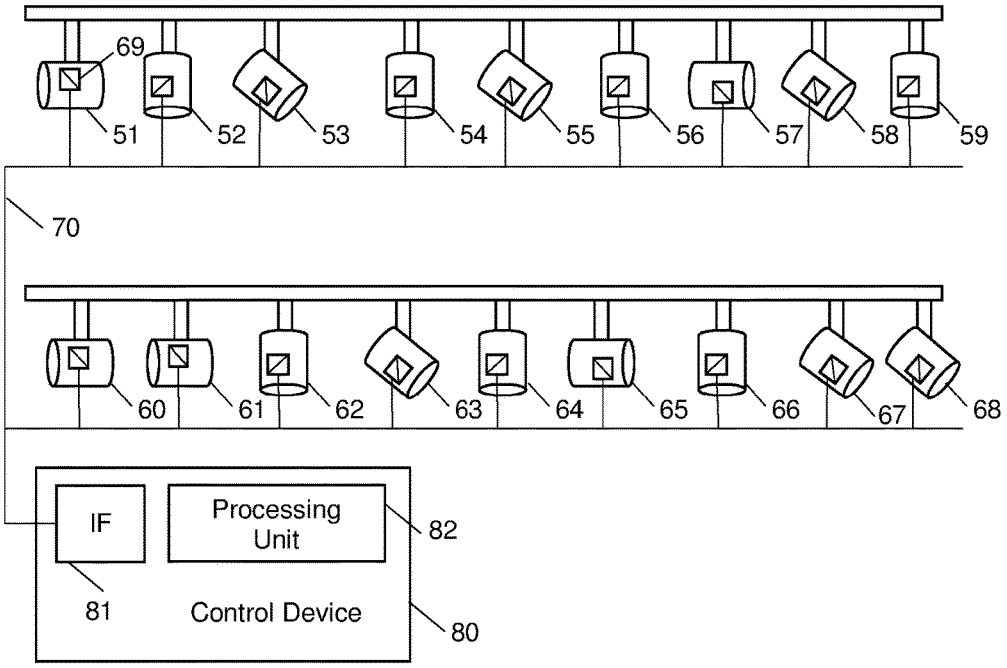
FIG. 1 shows schematically a system according to an embodiment of the present invention.

FIG. 1 shows schematically a system comprising a plurality of controllable luminaire devices 51 to 68 and a control device 80. The controllable luminaire devices 51 to 68 are coupled to the control device via a network 70. Each of the plurality of controllable luminaire devices 51 to 68 may comprise a corresponding interface for coupling the corresponding controllable luminaire device 51 to 68 to the network 70. The control device 80 comprises an interface IF 81 for coupling the control device 80, in particular a processing unit 82 of the control device 80, to the network 70. The network 70 may comprise a lighting network such as DALI (digital addressable lighting interface) or any other kind of wired or wireless network, for example a wired or wireless IP-based network, a Z-Wave network, a ZigBee network etc.

Each controllable luminaire device 51 to 68 comprises a sensor unit. In FIG. 1 the sensor unit of controllable luminaire device 51 is designated by reference sign 69. The remaining controllable luminaire devices 52 to 68 comprise each a corresponding sensor unit which are not referenced by dedicated reference signs for clarity reasons. The sensor units of the luminaire devices 51 to 68 are coupled via the network 70 to the control device 80. Sensor values of the sensor units may be communicated via the network 70 to the control device 80.

The controllable luminaire devices 51 to 68 may be arranged at different locations inside and outside of a building. For example, the controllable luminaire devices 51 to 59 may be arranged in another floor than the controllable luminaire devices 60 to 68. For example, the controllable luminaire devices 60 to 68 may be arranged in a first floor of the building and the controllable luminaire devices 51 to 59 may be arranged in a second floor of the building. Furthermore, each of the controllable luminaire devices 51 to 68 may be arranged such that light emitted from the corresponding controllable luminaire device is directed into a certain direction. In the example shown in FIG. 1, the controllable luminaire devices 51, 57, 60, 61, and 65 are arranged in a horizontal direction. Furthermore, controllable luminaire devices 52, 54, 56, 59, 62, 64, and 66 are arranged in a vertical direction. The controllable luminaire devices 53, 55, 58, 63, 67 and 68 are arranged in an oblique downward direction.

For example, each controllable luminaire device 51 to 68 may comprise a sensor configured to determine an orientation of the controllable luminaire device, for example a magnetometer configured to determine an orientation of the corresponding controllable luminaire device with respect to the geomagnetic poles. Furthermore, each controllable luminaire device 51 to 68 may comprise a pressure sensor configured to determine an ambient air pressure of the corresponding controllable luminaire device. The controllable luminaire devices 51 to 68 may each comprise additional sensors, for example a gyroscope or an accelerator for determining an orientation or movement of the controllable luminaire device.

Based on the ambient air pressure an altitude of the arrangement of the corresponding controllable luminaire device may be determined. Based on the sensor values the control device 80 may group the controllable luminaire devices 51 to 68 automatically as will be explained in more detail in the following in connection with FIGS. 2 and 3.

Figure 2:
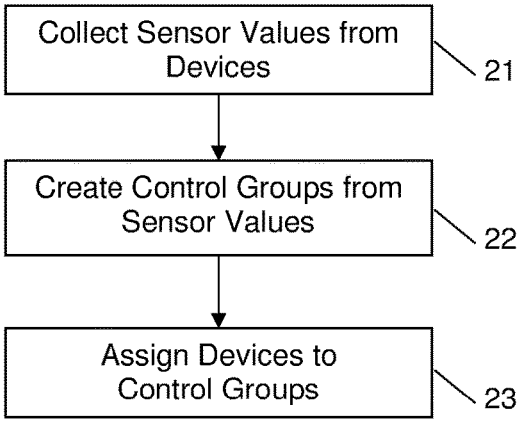
FIG. 2 shows schematically method steps of a method according to an embodiment of the present invention.

FIG. 2 shows method steps which may be performed for example by the control device 80 of FIG. 1. In step 21, the control device 80 may collect sensor values from the controllable luminaire devices 51 to 68 via the network 70. As described above, the collected sensor values may comprise for example sensor values indicating an orientation of each of the controllable luminaire devices 51 to 68 and an ambient air pressure of the environment at each of the controllable luminaire devices 51 to 68. Based on these sensor values the control device 80 may create in step 22 control groups.

For example, based on the orientation, three control groups may be created. A control group A may comprise horizontally arranged controllable luminaire devices, in the example of FIG. 1 the controllable luminaire devices 51, 57, 60, 61, and 65. A control group B may comprise vertically arranged controllable luminaire devices, in the example of FIG. 1 the controllable luminaire devices 52, 54, 56, 59, 62, 64, and 66. A control group C may comprise downwardly oblique arranged controllable luminaire devices, in the example of FIG. 1 the controllable luminaire devices 53, 55, 58, 62, 63, 67, and 68. The creation of the groups A, B, and C may be based on an analysis of the received sensor values by commonly known algorithms, for example cluster algorithms. Thus, each control group may be characterised by a certain property which is common to the members of the control group. In the example described above, the control groups are characterised by the orientation of controllable luminaire devices. Additionally or as an alternative, control groups may be predefined or configurable by a user.

Further control groups may be created based on sensor values provided by the sensor units 69 of the controllable luminaire devices 51 to 68. For example, based on the ambient air pressure determined with the pressure sensors, an altitude of the position of each controllable luminaire device may be determined. Based on this information, control groups for each floor of a building in which the controllable luminaire devices 51 to 68 are arranged may be created. In the example shown in FIG. 1, the sensor units of the controllable luminaire devices 51 to 59 may indicate an essentially same first altitude, and the sensor units of the controllable luminaire devices 60 to 68 may indicate an essentially same second altitude which is different from the first altitude. Based on this information a first control group U may be created for the first altitude and a second control group D may be created for the second altitude.

After the control groups have been created based on the sensor values from the controllable luminaire devices 51 to 68, the controllable luminaire devices 51 to 68 are assigned to the control groups (step 23). For example, corresponding control group identifiers may be assigned to the controllable luminaire devices 51 to 68 such that controllable luminaire devices assigned to a group can be controlled by broadcasting a command including the corresponding control group identifier. As an alternative, each controllable luminaire device 51 to 68 may comprise a unique identifier and the control device may set up look-up tables for each control group indicating the unique identifiers of the controllable luminaire devices assigned to the corresponding control group. Other mechanisms for assigning the controllable luminaire devices 51 to 68 to the created groups may be implemented depending on the network protocol of the network 70.

Based on the control groups and the assignment of the controllable luminaire devices to the control groups, groups of controllable luminaire devices may be controlled and configured commonly and synchronously. For example, a dim level, a colour or an optical exposure of the controllable luminaire devices assigned to a certain control group may be configured commonly and/or synchronously by issuing a command to the control group.

As described above, a controllable luminaire device may be assigned to a plurality of control groups having different characteristics. This may allow to form intersections or set units of the control groups. For example, this may allow to control commonly and/or synchronously all controllable luminaire devices which are arranged at the first altitude and which are horizontally oriented. In another example, this may allow to control commonly and/or synchronously all controllable luminaire devices which are arranged at the first altitude and which are oriented oblique downwardly or vertically.

Figure 3:
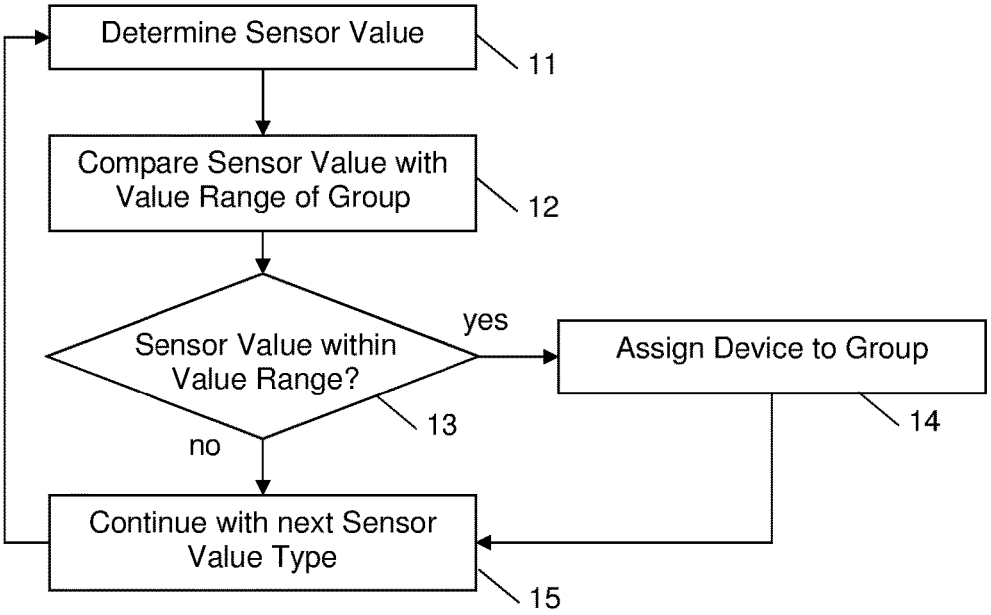
FIG. 3 shows schematically method steps of a method according to another embodiment of the present invention.

When new controllable luminaire devices are added to the lighting system or when controllable luminaire devices of the lighting system are rearranged or replaced, these controllable luminaire devices may be automatically and appropriately integrated as will be shown in the following in connection with a method shown in FIG. 3.

In step 11, a sensor value of a sensor unit of a newly added, rearranged or replaced controllable luminaire device is determined, for example by the processing unit 82 of the control device 80. The sensor value may be captured within the corresponding controllable luminaire device and transmitted via the network 70 and the interface 81 to the processing unit 82. The sensor value may relate to an orientation of the controllable luminaire device. The processing unit 82 may provide the above described control groups defining groups of controllable luminaire devices to be commonly controlled based on the orientation. The characteristics of the control group may be defined via a sensor value range assigned to each control group. For example, control group A may have a sensor value range for the orientation of the controllable luminaire devices which ranges from −20° to +20° with respect to the horizontal. Control group B may have a sensor value range for the orientation of the controllable luminaire devices which ranges from 70° to 110° with respect to the horizontal. Control group C may have a sensor value range for the orientation of the controllable luminaire devices which ranges from 25° to 65° with respect to the horizontal. In step 12 the sensor value received from the controllable luminaire device is compared with the value ranges of the control groups. In case the sensor value is within the value range of one of the control groups, the controllable luminaire device is assigned to the corresponding control group (steps 13 and 14). In case the sensor value from the controllable luminaire device does not fit to any of the sensor value ranges of the existing control groups, the controllable luminaire device may be assigned to the best matching control group or a new control group may be created or the controllable luminaire device may not be assigned to any of the control groups in this step. The controllable luminaire device may comprise a plurality of sensors, and for each type of sensor the above described method may be performed to assign the controllable luminaire device to the existing control groups. Therefore, in step 15 the method may be restarted with the next sensor type.

The next sensor type may relate for example to an altitude in which the controllable luminaire devices are installed. A corresponding sensor value may be received from the newly added, rearranged or replaced controllable luminaire device at the processing unit 82 of the control device 80. The sensor value may relate to an ambient air pressure and the processing unit 82 may determine a corresponding altitude based on the ambient air pressure. The processing unit 82 may provide the above-described control groups for controlling controllable luminaire devices based on the altitude. The characteristics of these control groups may be defined via sensor value ranges relating to altitude ranges which are assigned to the control groups. For example, control group U may have an altitude value range ranging from 84 to 88 m corresponding to an upper floor of a building, and control group D may have an altitude value range ranging from 80 to 84 m corresponding to a lower floor of the building. The altitude value determined for the controllable luminaire device is compared with these value ranges in step 12, and in case the altitude value is within of one of the altitude value ranges the controllable luminaire device is assigned to the corresponding group U or D in steps 13 and 14.

In step 15 the method may be continued with further sensor value types, for example a movement or acceleration the controllable luminaire device is experiencing when being arranged at a movable carrier, for example in connection with further controllable luminaire devices. Furthermore, a received signal strength value of an electromagnetic wirelessly transmitted communication may be used as a further sensor value indicating a distance between the control device 80 and the controllable luminaire device, such that for example controllable luminaire devices arranged within a certain distance to the control device 80 may be automatically assigned to the control device 80.

To sum up, controllable luminaire devices may be equipped with sensors, for example commodity sensors from the cell phone industry. These sensors are becoming more accurate and require lower power with the mobile evolution and are available in small form factors and are easy to communicate with. Adding a multipurpose sensor in a controllable luminaire device in a network enables to interact and probe the environment around the controllable luminaire devices. In particular, a gyrometer may be useful to determine orientation of a controllable luminaire device relative to gravity, a magnetometer may be useful to determine its orientation with respect to the poles, an accelerometer may be useful to determine a movement, pressure sensors may be useful to determine a relative level above/under sea level, and network strength indicators (RSSI) may be useful to determine its location compared to neighbour devices based on triangulation. For example, when commissioning a multi-storage building, controllable luminaire devices may report their relative altitude using the pressure sensor. This information may be used to automatically group controllable luminaire devices on the same floor, making it easier for the commission on one area or floor at a time. By using gyrometer and magnetometer sensors, an orientation of for example spotlights can be determined. This information may be used to dynamically and automatically group controllable luminaire in devices with same orientation. This may allow postinstallation reconfiguring of controllable luminaire devices without any programming or knowledge of lighting networks by using the embedded sensors.

For example, a shopping window designer may want to dim spotlights pointing down and make forward facing spotlights warmer colour temperature. When manually moving/positioning the spotlights, the group settings (down versus forward facing) is automatically updated based on the orientation which is determined by the sensors. Accordingly, down pointing spotlights may be commonly controlled and forward facing spotlights may be commonly controlled.

In another example, a museum using profile luminaire devices with dynamic zoom and focus, may want all controllable luminaire devices lighting a wall of art positions to have the same iris or optical zoom level and a soft faded edge regardless of where they are pointing. Using orientation determined by sensors in combination with the spotlight's relative position in a plane (based on position sensors), the targeted zoom/focus/iris settings may automatically adapted when spotlights are manually changed between exhibitions.

Finally, by using a received signal strength value of an electromagnetic wirelessly transmitted communication signal, for example a received signal strength indicator (RSSI), which is available in most wireless network solutions, in combination with state-of-the-art signal strength triangulation algorithms, it may be possible to automatically group and program networked controllable luminaire devices based on their related location compared to a map or floor plan.

The invention claimed is:

1. A method for automatically assigning a controllable luminaire device to a control group for commonly controlling controllable luminaire devices assigned to the control group, the method comprising:

determining a sensor value from a sensor unit assigned to the controllable luminaire device, and assigning the controllable luminaire device to the control group based on the sensor value, wherein the sensor value relates to a group of sensor value types, comprising:

a movement value, an orientation value with respect to the geomagnetic poles, an acceleration value, and an ambient air pressure value.

2. The method according to claim 1, wherein a plurality of control groups comprising the control group is provided, wherein to each control group a corresponding sensor value range is assigned, wherein the method comprises:

comparing the sensor value with the sensor value ranges assigned to the control groups, and assigning the controllable luminaire device to a control group of the plurality of control groups based on the comparisons.

3. A method for grouping a plurality of controllable luminaire devices for commonly controlling a group of controllable luminaire devices, the method comprising:

determining for each controllable luminaire device of the plurality of controllable luminaire devices a corresponding sensor value from a sensor unit assigned to the controllable luminaire device, creating at least one control group based on the sensors values of the plurality of controllable luminaire devices, wherein the control group defines a group of controllable luminaire devices to be commonly controlled, and assigning each controllable luminaire device of the plurality of controllable luminaire devices to a control group of the created at least one control group based on the corresponding sensor value, wherein the sensor value relates to a group of sensor value types, comprising:

a movement value, an orientation value with respect to the geomagnetic poles, an acceleration value, and an ambient air pressure value.

4. A control device, comprising:

an interface unit for receiving a sensor value from a sensor unit assigned to a controllable luminaire device, and a processing unit configured to assign the controllable luminaire device to a control group based on the sensor value, wherein the control group defines a group of controllable luminaire devices to be commonly controlled, wherein the sensor value relates to a group of sensor value types, comprising:

a movement value, an orientation value with respect to the geomagnetic poles, an acceleration value, and an ambient air pressure value.

5. The control device according to claim 4, wherein a plurality of control groups comprising the control group is provided, wherein to each control group a corresponding sensor value range is assigned, wherein the processing unit configured to compare the sensor value with the sensor value ranges assigned to the plurality of control groups, and to assign the controllable luminaire device to a control group of the plurality of control groups based on the comparisons.

6. A control device, comprising:

an interface unit for receiving sensor values of a plurality of sensor units, each sensor unit of the plurality of sensor units being assigned to a corresponding controllable luminaire device of a plurality of controllable luminaire devices, and a processing unit configured:

to create at least one control group based on the sensor values of the plurality of controllable luminaire devices, wherein each control group defines a group of controllable luminaire devices to be commonly controlled, and to assign each controllable luminaire device of the plurality of controllable luminaire devices to a control group of the created at least one control group based on the corresponding sensor value, wherein the sensor value relates to a group of sensor value types, comprising:

a movement value, an orientation value with respect to the geomagnetic poles, an acceleration value, and an ambient air pressure value.

7. A system comprising:

a controllable luminaire device, a sensor unit assigned to the controllable luminaire device, and a control device, comprising:

an interface unit for receiving a sensor value from the sensor unit assigned to the controllable luminaire device, and a processing unit configured to assign the controllable luminaire device to a control group based on the sensor value, wherein the control group defines a group of controllable luminaire devices to be commonly controlled, wherein the sensor unit comprises at least one of a group of sensor units comprising:

a gyroscope configured to determine a movement of the controllable luminaire device, a magnetometer configured to determine an orientation of the controllable luminaire device with respect to the geomagnetic poles, an accelerometer configured to determine an acceleration of the controllable luminaire device, a pressure sensor configured to determine an ambient air pressure of the controllable luminaire device, and a power meter configured to determine a received signal strength of an electromagnetic wirelessly transmitted communication signal received at the controllable luminaire device.

8. The system according to claim 7, wherein the sensor unit is integrated in the controllable luminaire device to which the sensor unit is assigned.

9. A system comprising:

a plurality of controllable luminaire devices, a plurality of sensor units, wherein each sensor unit of the plurality of sensor units is assigned to a corresponding controllable luminaire device of the plurality of controllable luminaire devices, and a control device, comprising:

an interface unit for receiving sensor values from the plurality of sensor units, and a processing unit configured:

to create at least one control group based on the sensor values of the plurality of controllable luminaire devices, wherein each control group defines a group of controllable luminaire devices to be commonly controlled, and to assign each controllable luminaire device of the plurality of controllable luminaire devices to a control group of the created at least one control group based on the corresponding sensor value, wherein at least one sensor unit of the plurality of the sensor units comprises at least one of a group of sensor units comprising:

a gyroscope configured to determine a movement of the controllable luminaire device, a magnetometer configured to determine an orientation of the controllable luminaire device with respect to the geomagnetic poles, an accelerometer configured to determine an acceleration of the controllable luminaire device, a pressure sensor configured to determine an ambient air pressure of the controllable luminaire device, and a power meter configured to determine a received signal strength of an electromagnetic wirelessly transmitted communication signal received at the controllable luminaire device.

10. The system according to claim 9, wherein at least one sensor unit of the plurality of the sensor units is integrated in the corresponding controllable luminaire device to which the sensor unit is assigned.

* * * * *